US007540045B2

(12) United States Patent
Nativ

(10) Patent No.: US 7,540,045 B2
(45) Date of Patent: Jun. 2, 2009

(54) SIT-TO-STAND APPARATUS INCLUDING PULLEY, HANDLE, AND LEG BRACE MOUNTED ABOVE SUPPORTING STRUCTURE ON ADJACENT, DIFFERING HEIGHT VERTICAL MEMBERS

(76) Inventor: Avinoam Nativ, 3428 Baskins Beach Road, R.R. #1, Dunrobin, ON (CA) K0A 1T0

( * ) Notice: Subject to any disclaimer, the term of this patent is extended or adjusted under 35 U.S.C. 154(b) by 8 days.

(21) Appl. No.: 11/752,647

(22) Filed: May 23, 2007

(65) Prior Publication Data

US 2007/0219069 A1 Sep. 20, 2007

Related U.S. Application Data

(63) Continuation of application No. 10/859,181, filed on Jun. 3, 2004, now abandoned.

(51) Int. Cl.
*A61G 7/14* (2006.01)

(52) U.S. Cl. ..... 5/86.1; 5/89.1

(58) Field of Classification Search ..... 5/87.1, 5/86.1, 85.1, 84.1, 83.1, 81.1 R, 89.1; 482/66, 482/68; 280/87.041; 297/5, 6
See application file for complete search history.

(56) References Cited

U.S. PATENT DOCUMENTS 503,105 A 8/1893 Tingley
1,611,807 A 12/1926 Bergh
1,641,388 A 9/1927 Jenkins
1,782,406 A 11/1930 Bureau
2,516,553 A 7/1950 Cole
2,625,202 A 1/1953 Richardson et al.
2,665,685 A 1/1954 Kaufman
2,812,010 A 11/1957 Abdallah
3,721,437 A 3/1973 Skaricic
3,778,052 A 12/1973 Andow et al.
3,999,228 A 12/1976 Thomas
4,111,414 A 9/1978 Roberts
4,117,561 A 10/1978 Zamotin
4,431,184 A 2/1984 Lew et al.
4,484,366 A 11/1984 Koontz
4,530,122 A 7/1985 Sanders et al.
4,644,595 A 2/1987 Daniel
4,918,771 A 4/1990 James
4,948,156 A * 8/1990 Fortner ..... 280/304.1
4,973,044 A 11/1990 Jones
4,976,623 A * 12/1990 Owsley ..... 434/247
5,016,300 A 5/1991 Jandrakovic
5,042,796 A 8/1991 Jibril
5,064,191 A 11/1991 Johnson
5,123,131 A 6/1992 Jandrakovic
5,158,516 A 10/1992 Johnson
5,165,123 A 11/1992 Colpron
5,221,241 A * 6/1993 Bare, II ..... 482/43
5,235,711 A 8/1993 Jandrakovic
5,309,584 A * 5/1994 Parker ..... 5/87.1
5,333,333 A 8/1994 Mah
5,372,561 A 12/1994 Lynch (Continued)

*Primary Examiner*—Gay Ann Spahn
(74) *Attorney, Agent, or Firm*—Anne Kinsman; Borden Ladner Gervais LLP

(57) ABSTRACT

An apparatus for assisting a person to stand. The apparatus comprises a mobile support structure, a pulley system, a counterbalance weight and a harness. The counterbalancing weight is coupled to the pulley system and the harness, which is coupled to the person being assisted in standing. The apparatus may also comprise a leg brace, a handle and wheel assemblies.

10 Claims, 6 Drawing Sheets

U.S. PATENT DOCUMENTS 5,502,851 A 4/1996 Costello
5,530,976 A * 7/1996 Horcher ..... 5/89.1
5,569,129 A 10/1996 Seif-Naraghi et al.
5,603,677 A 2/1997 Sollo
5,644,805 A 7/1997 Horcher
5,662,560 A * 9/1997 Svendsen et al. ..... 482/69
5,667,461 A * 9/1997 Hall ..... 482/69
5,695,432 A 12/1997 Soderlund
5,704,881 A 1/1998 Dudley
5,878,450 A * 3/1999 Bouhuijs ..... 5/86.1
6,139,475 A 10/2000 Bessier et al.
6,175,973 B1 1/2001 Hakamiun et al.
6,273,844 B1 8/2001 Kelsey et al.
6,449,785 B1 9/2002 Liljedahl
6,578,594 B1 6/2003 Bowen et al.
6,581,222 B1 6/2003 Liljedahl
6,689,075 B2 2/2004 West
6,821,233 B1 11/2004 Colombo et al.
6,899,660 B1 5/2005 Chin et al.
6,935,353 B2 8/2005 Hawkes et al.
6,942,630 B2 9/2005 Behan
7,306,548 B2 * 12/2007 Martin et al. ..... 482/92
7,356,858 B2 * 4/2008 Summers ..... 5/83.1
2002/0065173 A1 5/2002 Cook
2005/0217025 A1 * 10/2005 Barattia ..... 5/86.1

* cited by examiner

SIT-TO-STAND APPARATUS INCLUDING PULLEY, HANDLE, AND LEG BRACE MOUNTED ABOVE SUPPORTING STRUCTURE ON ADJACENT, DIFFERING HEIGHT VERTICAL MEMBERS

CROSS REFERENCE TO RELATED APPLICATIONS

This application is a continuation of U.S. patent application No. 10/859,181, filed Jun. 3, 2004, now abandoned, which is incorporated herein by reference and from which the benefit of priority is claimed.

FIELD OF THE INVENTION

The present invention relates to the field of mobility enhancement and rehabilitation equipment. More particularly, the present invention relates to the field of mobility enhancement and rehabilitation equipment for people with severe paresis of the lower extremities.

BACKGROUND OF THE INVENTION

Our present understanding of motor relearning and skill acquisition makes it very clear that an active stage of intensive and speed sensitive training is essential for the development of new movements or skills. The field of rehabilitation is not different in that respect but, unfortunately, in many cases, the requirement for practice cannot be practically fulfilled because of the nature of the impairment, as well as, the lack of tools required to enable the desired movement. For example, a person with a severe paresis of the lower extremities may not be able to practice tasks needed to improve his/her ability to stand-up from sitting. Even with one or two people supporting that individual, the desired freedom of movement may not be achieved to enable the development of the strength and control associated with the standing up motion.

The gradual build-up, reshaping and refinement of motor skills are part of the process of acquiring skills. Skill-acquisition processes have been extensively studied in an effort to better understand what may facilitate the normal acquisition of skills and also the acquisition of skills in the context of rehabilitation programs. Intensive practice gradually leads to the automation of the learned skill and finally to successful incorporation of that skill into daily activities or sports activities, i.e., a process that should no longer be attention demanding.

In order to show progress in the development of the movement/action, the subject should practice efficiently and sufficiently. The question remains of how to provide efficient and sufficient training for standing up from sitting to someone who cannot initiate such movement on his/her own. What is needed is an apparatus that supports and enables such movement in a safe manner i.e. a sit-to-stand assisting device whose main function is to enable the coordinative sequence of efforts associated with the standing up movement even when the training person is otherwise not able to stand up. The repeated practice of standing and squatting would then gradually develop the strength, balance and coordination associated with the skill of standing.

There are presently many people who, even with manual support, are not able to attempt to stand. These people would most likely continue to atrophy, both from a neurological and muscular perspective, with the realistic chance of never being able to stand up again. At present, apparatuses that can allow the training of standing for such extremely weak individuals do not seem readily available. There are devices that lift people to a standing position and others that maintain them in standing position. These devices, however, do not create the optimal learning environment, which is essential for the skill of standing to be retrieved or relearned.

The use of a pulley system to help propel the body upward is demonstrated in U.S. Pat. No. 4,111,414 issued Sep. 5, 1978 and incorporated herein by reference. There, the line of pull is substantially vertical and the goal of the device is to assist an able person to practice pull-ups on a bar. Since the target practice is not standing, there is no knee support. The vertical angle of pull does not allow for the building of pressure on the legs—a pressure essential for the standing up motion. Finally, this device is stationary—connected to the wall—and therefore does not allow for the dynamic practice once standing is achieved, i.e. does not allow the person, once standing, to walk about with support.

There are some inventions that aim at enabling the efforts to stand through the use of pulleys. More common is the use of a pulley to winch up a person to a standing position as disclosed in U.S. Pat. No. 6,139,475, issued Oct. 31, 2000 and incorporated herein by reference. However, this disclosure does not allow for the independent practice of standing up. It also does not have the lower extremity support that would be required for people with extremely weak lower extremities to attempt standing up. The device is geared for ambulation rather than the act of standing up from sitting.

U.S. Pat. No. 5,064,191, issued Nov. 12, 1991 and incorporated herein by reference is another example of the use of pulleys to provide vertical pull but in this case it is a rebound exerciser. Consistent with its intended function, this device does not provide knee support and cannot help propel a person in the motion required to load the lower extremities and subsequently, stand up.

Therefore, it is desirable to provide a machine that can give variable assist to a person who relearns to stand. Thus, the enabling of the desired motion, i.e. standing, would gradually improve the strength, balance and control associated with that movement. It would also be important to add mobility to such device, thus allowing for gradual progression of the learned skills from a static to a dynamic form.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims concluding the Specification.

SUMMARY OF THE INVENTION

In a first aspect, the present invention provides an apparatus to enable a person to practice standing from a seated position. The apparatus comprises a support structure and a pulley arrangement coupled to the support structure. The apparatus further comprises a counterbalance weight, a cable coupled to the pulley arrangement and to the counterbalance weight, and harness attached to a first end of the cable, the harness to couple to a seat area of the person, the counterbalance weight applying a force to the cable, the pulley arrangement directing the cable and at least a portion of the force to pull the person in a forward direction and in an upward direction, in a way that assists the person to stand from the seated position.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
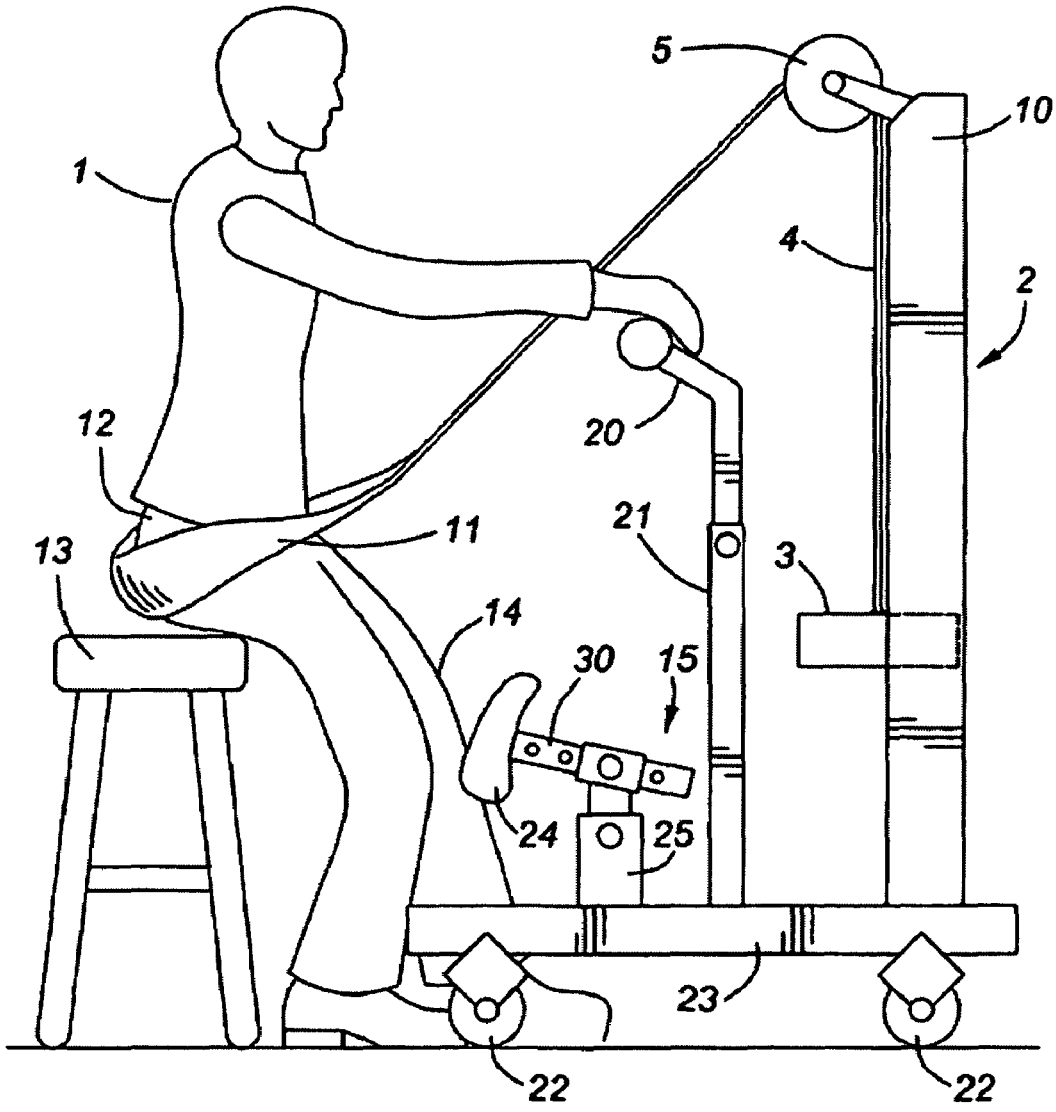
FIG. 1 is a depiction of a person using a one-pulley sit-to-stand apparatus.

FIG. 1 depicts a person 1 being assisted to stand by apparatus 2 (also referred to as a sit-to-stand apparatus). There, a counterbalancing weight 3 is coupled at an end of cable 4 that is received by a pulley 5 coupled to a vertical member 10. Although shown as fixed, the height at which pulley 5 is attached to vertical member 10 may be variable. The other end of the cable 4 is coupled to a harness 11, which is in turn coupled to person 1, preferably by embracing their buttocks. Here, the harness 11 is disposed on the seat area 12 of the person 1 but may be otherwise coupled to the body. A mechanism for releasably coupling or attaching the harness 11 to the cable 4 may be provided.

Figure 2:
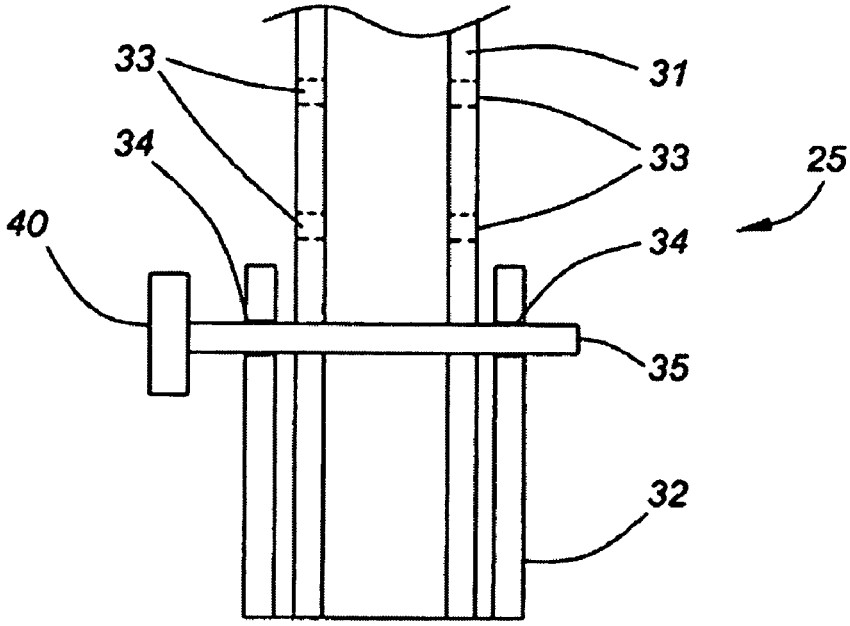
FIG. 2 depicts a height adjustment mechanism of the leg brace.

In FIG. 1, the person 1 is shown standing partly after having been assisted to move from a seated position on bench 13. The person 1 has his/her leg area 14 braced by leg brace 15 and is holding on to handle means 20 disposed at the upper end of vertical member 21. The apparatus 2 is provided with wheel assemblies 22, preferably including castor wheel assemblies, attached to horizontal member 23. The leg brace 15 comprises a contact area 24 for abutting the leg area 14, a vertical member 25 and a transverse member 30. The height of the contact area 24 may be adjusted by adjusting the length of vertical member 25, which could be accomplished by having vertical member 25 comprise two slidingly inter-fitting components 31 and 32 as partly shown in a cross-sectional view in FIG. 2. There, component 31 is provided with holes 33 and component 32 is provided with holes 34. A pin 36 having a knob 40 is inserted through holes 34 and a pair of holes 30 once the components 31 and 32 have been slidingly adjusted so that a desired height of contact area 24 is attained.

Figure 3:
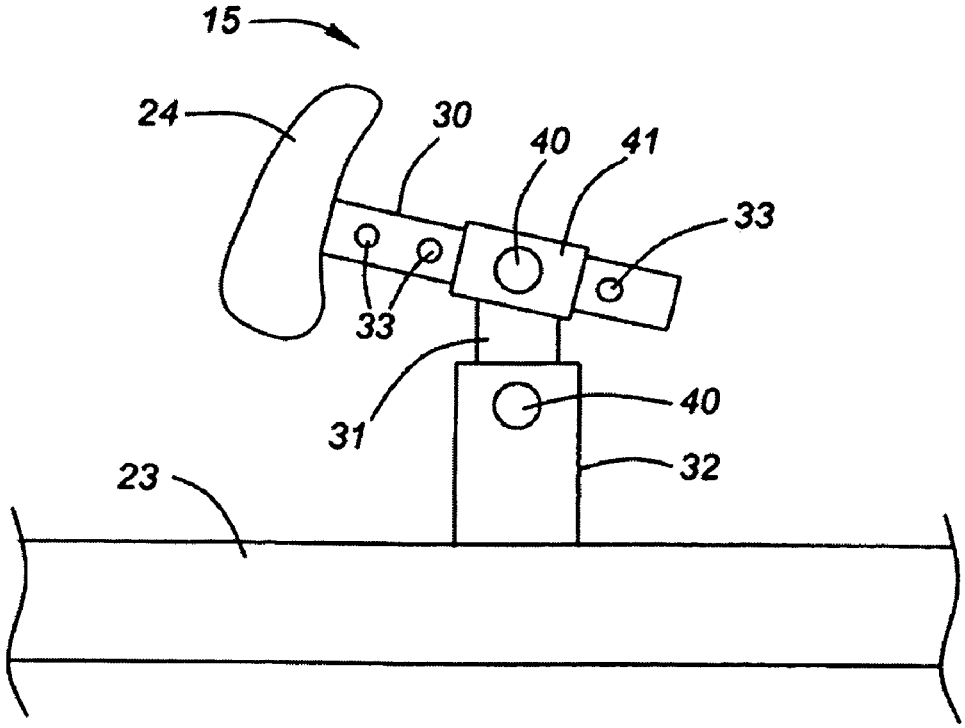
FIG. 3 is a depicts a horizontal adjustment mechanism of the contact area of the leg brace.

As depicted in FIG. 3, a horizontal position of the contact area 24 may be adjusted by having holes 33 in transverse member 30 and having transverse member 30 fit inside a collar 40 also provided a hole (not depicted in FIG. 3). The adjustment of the horizontal position of contact area 24 is achieved by sliding transverse member 30 in collar 41 until a desired horizontal position is attained and then inserting a pin 35 attached to a knob 40 through the hole of the collar and through one of the holes 33 of the transverse bar 30. The transverse member 30 may be at an angle as depicted in FIGS. 1 and 3 or may be substantially parallel to horizontal member 23. Furthermore, a mechanism for adjusting the angle of transverse member 30 may be provided. The vertical position of handle means 20 may be adjusted in a manner similar to the height adjustment of leg brace 15 and a horizontal adjustment of handle means 20 could be provided in a manner similar to the manner by which the adjustment of the horizontal position of the contact area 24 was described.

As another option, the height of pulley 5 could be made adjustable by incorporating into apparatus 2 a height adjusting mechanism similar to the height adjusting mechanism described for the leg brace 15 or any other known height adjusting mechanism.

A person 1 wanting to use apparatus 2 could be provided with a releasable harness 11 and adjust the harness on seat area 12. Following this, the person 1 could sit on bench 13 and a trainer or therapist could grab the free end of cable 4, pull on cable 4, thereby lifting counterbalancing weight 3 having been selected according to the weight and strength of person 1, and attach cable 4 to harness 11. Then, person 1 having his/her leg area 14 braced by leg brace 15 and holding on to handle means 20 would be assisted in standing by apparatus 2.

An alternate method would have person 1 adjust harness 11 on seat area 12 and stand with his/her leg area 14 braced by leg brace 15 while holding to handle means 20 and then have a trainer or therapist attach cable 4 to harness 11. The person could then assume a sitting position on bench 13 and subsequently practice standing up from the sitting position. It will be clear to those familiar in the art that a person 1 having sufficient strength could use apparatus 2 without assistance from a trainer or a therapist.

Figure 4:
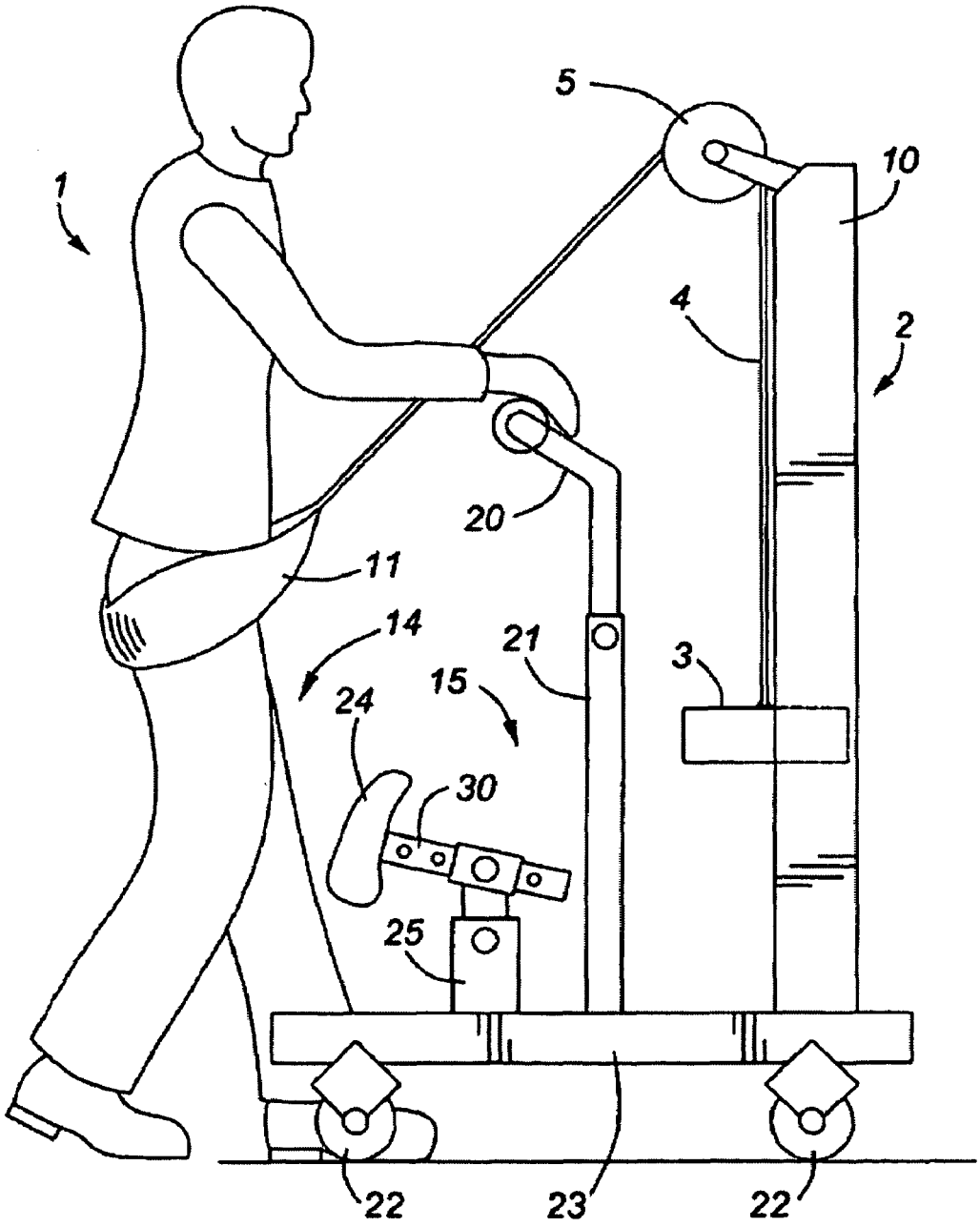
FIG. 4 depicts a person walking about with the one-pulley sit-to-stand apparatus.
Figure 7:
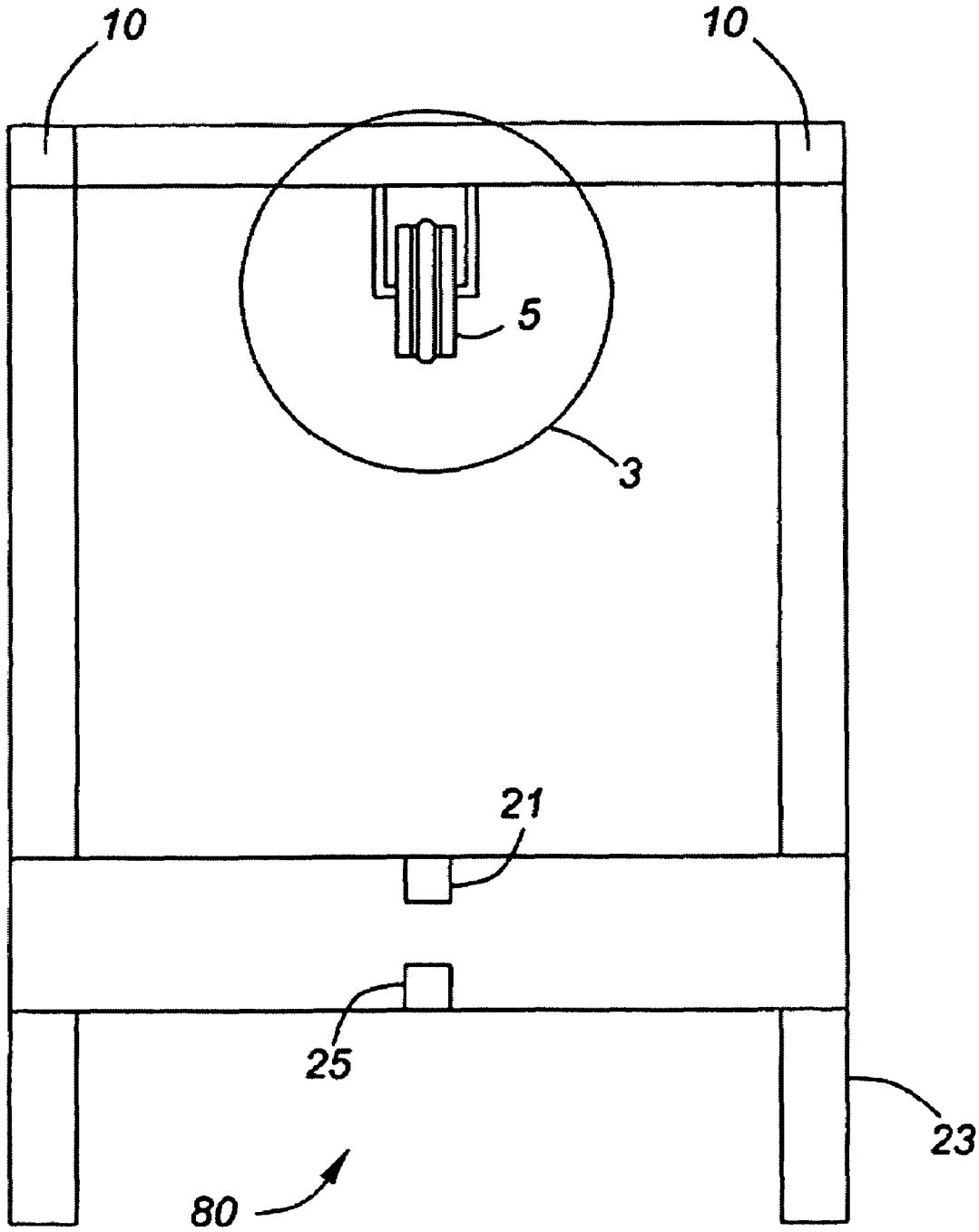
FIG. 7 is a top partial top view depiction of the embodiment of FIG. 1.

Additionally, apparatus 2 can be used to assist person 1 in walking. Since vertical members 10, 21 and 25, horizontal member 23 and wheel assemblies 22 make up a mobile support structure, person 1, holding on to handle means 20, can be assisted in walking about when in a standing position as depicted in FIG. 4. As shown in FIG. 7, which is a partial top view of the embodiment of FIG. 1, a recessed area 80 may be provided in front of the legs for allowing the person to walk uninhibitedly. Furthermore, the mobile support structure makes it possible to move the apparatus to different locations in, e.g., a clinic where space restriction may not make it possible to dedicate an area to a fixed sit-to-stand apparatus. An alternate embodiment to the embodiment just described would be one without wheel assemblies i.e. a sit-to-stand apparatus meant for assisting a person to stand only, not to walk.

Figure 5:
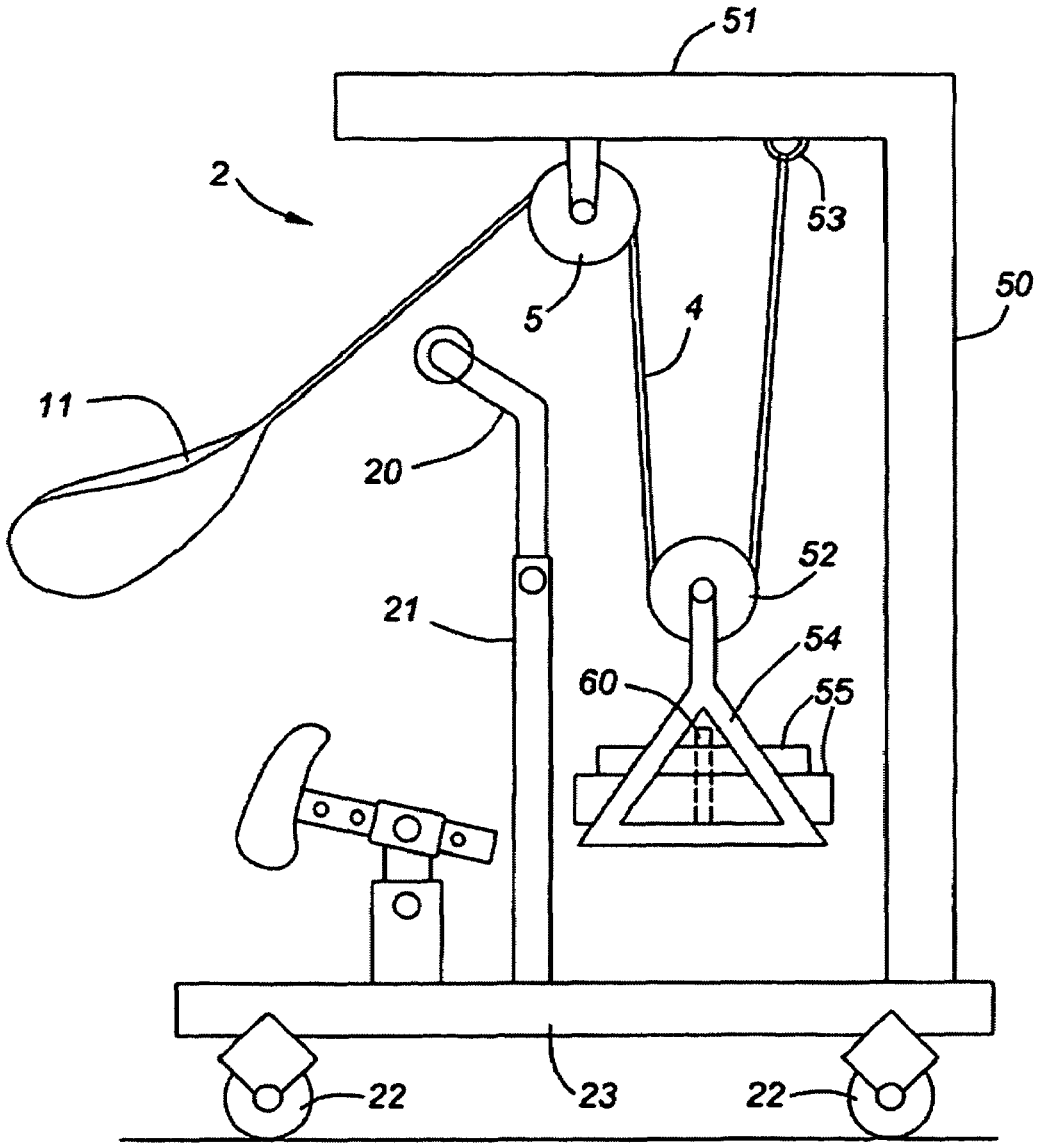
FIG. 5 depicts a two-pulley sit-to-stand apparatus.

Another embodiment of the invention is shown in FIG. 5. Here, an end of cable 4 is coupled at coupling area 53 of horizontal member 51, which is coupled to vertical member 50, which is in turn coupled to horizontal member 23. A counterbalancing weight support structure 54 is attached to pulley 52, which receives cable 4. Cable 4 is also received by pulley 5 and is coupled to harness 11. Harness 11 is for coupling to person 1 in a way similar to the depiction of FIG. 1. A counterbalancing weight comprising multiple individual weights 55 is disposed on the counterbalancing weight support structure 54.

The multiple individual weights 55 can be provided with a bore and the counterbalancing weight support structure 54 can be provided with a post 60 coupled to the counterbalancing weight support structure 54 in order to provide a secure placement of the multiple individual weights 55 on the counterbalancing weight support structure 54. The secure placement is achieved by placing the individual weights 55 on the counterbalancing weight support structure 54 with the post penetrating the individual weights 55 through the bores. The individual weights 55 may be calibrated.

Figure 6:
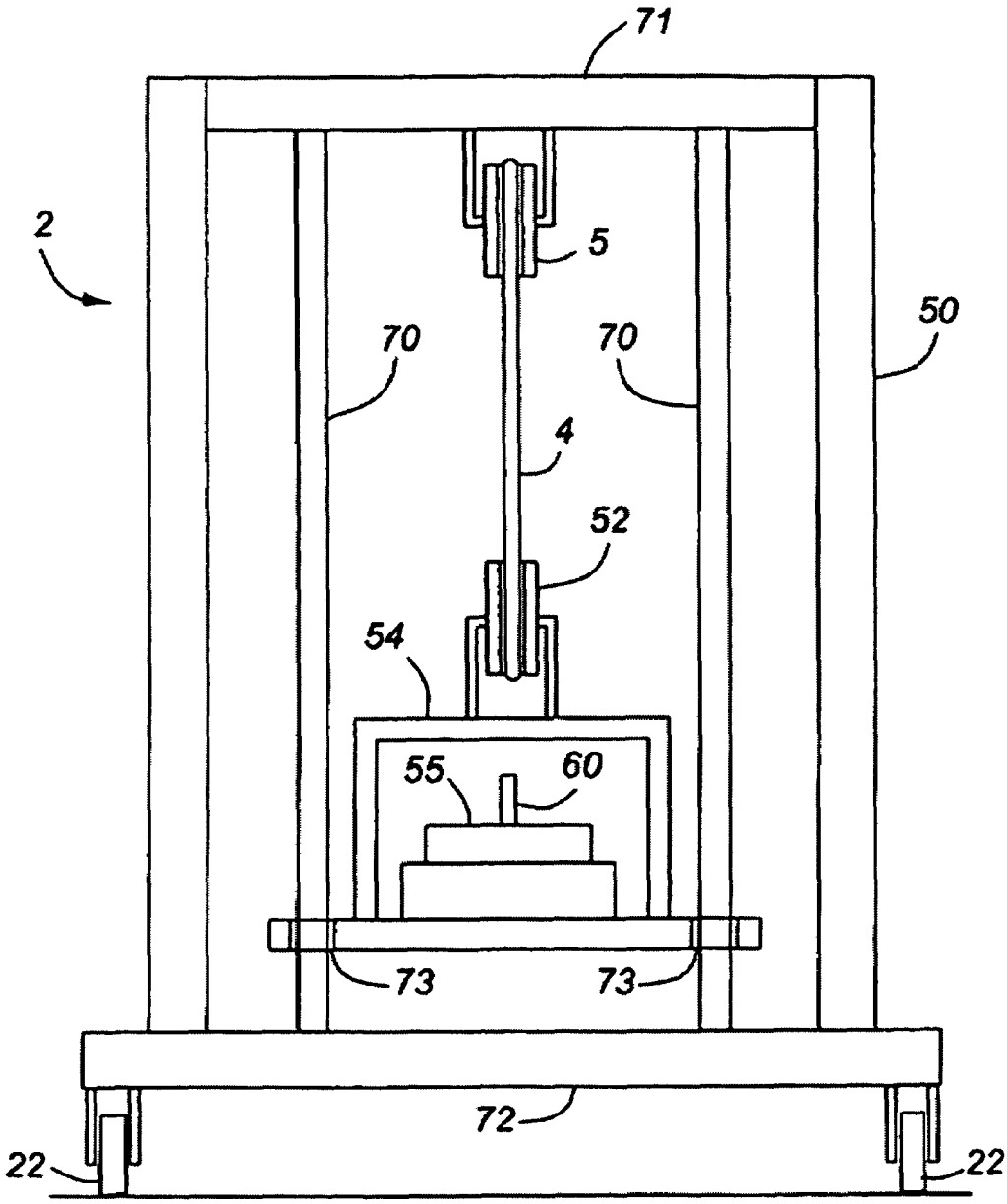
FIG. 6 depicts a guide post means used in guiding the counterbalancing weight support structure.

The arrangement of pulleys 52 and 5 provides a force-dividing effect between the sum weight of the individual weights 55 and the weight of the counterbalancing weight support structure 54 and the force applied to the person 1. As shown in FIG. 6, guide post means 70 can be provided on apparatus 2 in order to guide counterbalancing weight support structure 54 as it moves up and down as person 1 uses apparatus 2. Guide post means 70 may be coupled to horizontal members 71 and 72 and traverse holes 73 provided on counterbalancing weight support structure 54. For the sake of clarity, harness 11, leg brace 15, handle means 20, vertical member 21 and person 1 were not depicted in FIG. 6. Other means of providing a counterbalancing weight support structure for individual weights may be provided.

It will be understood by one familiar in the art that wheel assemblies 22 having locking wheels (not depicted) may be provided in embodiments of the present invention.

The foregoing has constituted a description of specific embodiments showing how the invention may be applied and put into use. These embodiments are only examples.

The invention in its broadest, and more specific aspects is further described and defined in the claims which now follow.

These claims, and the language used therein, are to be understood in terms of the variants of the invention that have been described. They are not to be restricted to such variants, but are to be read as covering the full scope of the invention as is implicit within the invention and the disclosure that has been provided herein.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. An apparatus to enable a person to practice standing from a seated position, the apparatus comprising:

a support structure;

a pulley coupled to the support structure through a first substantially vertically extending structure, the pulley being at a first height;

a handle coupled to the support structure through a second substantially vertically extending structure, distinct from the first vertically extending structure, the handle secured to the second substantially vertically extending structure at an end of the second substantially vertically extending structure, the handle being at a second height suitable to be grabbed by the person while practicing to stand;

an adjustable leg brace coupled to the support structure, the adjustable leg brace being at a third height, the adjustable leg brace having a contact area to brace the legs of the person while practicing to stand, the second vertically extending structure being positioned between the adjustable leg brace and the first vertically extending structure, the first height being greater that the second height, the second height being greater than the third height, the first substantially vertically extending structure and the contact area of the adjustable leg brace defining an adjustable horizontal spacing therebetween, the adjustable horizontal spacing being adjustable in accordance with a position of the adjustable leg brace;

a counterbalance weight;

a cable coupled to the pulley and to the counterbalance weight; and a harness attached to a first end of the cable, the harness to couple to a seat area of the person, a segment of the cable extending from the pulley to the harness being at an oblique angle with respect to the first substantially vertically extending structure when the harness is coupled to the seat area of the person, the oblique angle resulting from the pulley being at the first height and from the adjustable horizontal spacing between the first substantially vertically extending structure and the contact area of the adjustable leg brace, a value of the oblique angle being defined in accordance with the height of the pulley and with the adjustable horizontal spacing, the counterbalance weight applying a force to the cable, the segment of cable extending from the pulley to the harness directing a portion of the force to pull on the harness at the oblique angle, resulting in the person being pulled in a forward direction and in an upward direction, in a way that enables the person to practice standing from a seated position.

2. The apparatus of claim 1 wherein, a position of the handle is adjustable.

3. The apparatus of claim 1 wherein, the counterbalance weight is adjustable.

4. The apparatus of claim 1 further comprising wheels connected to the support structure to provide mobility to the apparatus.

5. The apparatus of claim 1 wherein, the cable includes a second end connected to the counterbalance weight.

6. The apparatus of claim 1 wherein, the counterbalance weight includes a weight support structure to which individual weights can attached.

7. The apparatus of claim 6 further comprising at least one guide post cooperating with the weight support structure to restrict movement of the weight support structure to one direction.

8. The apparatus of claim 1 further comprising:

a moveable pulley coupled to the cable, wherein a second end of the cable is secured to the support structure at an anchor position, the moveable pulley being disposed between the anchor position and the first pulley, the counterbalance weight being attached to the moveable pulley.

9. The apparatus of claim 8 wherein, the counterbalance weight includes a weight support structure to which individual weights can be attached.

10. The apparatus of claim 9 further comprising at least one guide post cooperating with the weight support structure to restrict movement of the weight support structure to one direction.

* * * * *